US007865972B2

(12) United States Patent
Simon

(10) Patent No.: US 7,865,972 B2
(45) Date of Patent: Jan. 11, 2011

(54) CLOTHING FOR NON-AMBULATORY AND WHEELCHAIR BOUND PEOPLE

(76) Inventor: Gernot Simon, 835 Christina Cir., Oldsmar, FL (US) 34677

( * ) Notice: Subject to any disclaimer, the term of this patent is extended or adjusted under 35 U.S.C. 154(b) by 1058 days.

(21) Appl. No.: 11/611,917

(22) Filed: Dec. 18, 2006

(65) Prior Publication Data

US 2008/0141432 A1 Jun. 19, 2008

(51) Int. Cl.
*A41D 13/00* (2006.01)

(52) U.S. Cl. ..... 2/114; 2/227; 2/69

(58) Field of Classification Search ..... 2/69, 2/69.5, 227, 228, 238, 114, 105, 106, 113, 2/115, 249–251; 450/96, 106, 112
See application file for complete search history.

(56) References Cited

U.S. PATENT DOCUMENTS 2,349,974 A * 5/1944 McMasters ..... 2/227
2,886,622 A * 5/1959 Shannon ..... 429/175
3,110,903 A * 11/1963 Burchard ..... 2/221
4,266,299 A * 5/1981 Beal ..... 2/46
4,736,467 A * 4/1988 Schwarze et al. ..... 2/114
5,136,727 A * 8/1992 Brisco ..... 2/409
5,761,747 A * 6/1998 Eagleson ..... 2/400
5,802,611 A * 9/1998 McKenzie et al. ..... 2/69
5,826,273 A * 10/1998 Eckes ..... 2/69
5,926,851 A * 7/1999 Kovalik ..... 2/227
6,074,274 A * 6/2000 Pyatt et al. ..... 450/101
6,567,989 B1 * 5/2003 Martinez ..... 2/69
6,647,551 B2 * 11/2003 Palumbo ..... 2/69

* cited by examiner

*Primary Examiner*—Gloria Hale
(74) *Attorney, Agent, or Firm*—Dennis G. LaPointe

(57) ABSTRACT

Clothing for non-ambulatory people in the form of a shirt and pant legs. A pair of pant legs is each formed and sized to be pulled over a person's leg and having a length so as to reach a person's thigh area, with the pant legs being secured to the thigh area. The shirt has a front body portion and a back body portion. The back body portion is sized and configured to have a length sufficient to extend down to proximately a small or waist area of a person's back. The front body portion is sized and configured to have a length sufficient to extend down and be draped over a thigh area of the person, and has extended side portions configured for draping over each side of the person's body from proximately a waist area of the person down to the thigh area of the person.

7 Claims, 4 Drawing Sheets

CLOTHING FOR NON-AMBULATORY AND WHEELCHAIR BOUND PEOPLE

FIELD OF THE INVENTION

The invention relates to special clothing for non-ambulatory and wheelchair bound people to facilitate the proper dressing of such handicapped people.

BACKGROUND OF THE INVENTION

To properly dress oneself, one must be able to stand to pull pants all the way up and to tuck in a shirt. Regrettably, people who are non-ambulatory and wheel chair bound cannot do this simple process. To wear pants, these handicapped people must first pull them up to their thighs and then bunch the rest, unless someone can lift them up from the seating position.

Shirts, t-shirts, sweaters and such cannot be fully pulled down, as there is no way for the person to pull these down and they cannot lift or stand up to pull the shirt under their buttocks, resulting in lots of clothing bunched up in the small of the back. It is uncomfortable and unsightly, and because it is not pulled down, there is always bare skin showing.

Garments made today are made for people who can stand. No thought has been given to the disabled or handicapped person, such as someone with multiple sclerosis (MS).

SUMMARY OF THE INVENTION

The present invention is in the form of clothing for use by non-ambulatory people and wheelchair bound people.

In one embodiment, the invention is clothing for non-ambulatory and wheelchair bound people comprising a pair of pant legs formed and sized to be pulled over a person's leg and having a length so as to reach a person's thigh area. The pant legs each have means at its upper end for securing the pant leg to the thigh area. In a preferred embodiment, the means at its upper end for securing the pant leg to the thigh area is sewn-in elastic band or a strap using hook and loop type of fasteners. Of course, there are other means known in the art that are contemplated to be used in the invention.

The important feature is that the person can place the pant legs on without the need to stand.

In another embodiment of the pant legs, a cut portion at the upper end of each pant leg is included. The cut portion, when opened, forms a generally V-shaped cut. Also included are means for closing and securing the cut portion. Again, there are several means for closing and securing the cut portion known in the art including zipper means, or hook and loop fasteners having corresponding mating portions attached to each side of the formed V-shaped cut.

For the pant leg and/or the V-shaped cut, means such as snap buttons, regular buttons and button holes, can be used if desired according to the look and style that the garment designer is trying to achieve and consideration of the fabric used.

In another embodiment, the clothing can include a pocket portion near a bottom end of one of the pant legs. Although it certainly can be used for multiple purposes, it is a desired feature for primarily accommodating the placement and hiding of a bodily fluid waste bag. Preferably, the pocket portion has means for at least partially closing an opening of the pocket portion. Again, this can be done with hook and loop fastener devices, or alternatively with snap buttons or regular buttons and button holes.

In a preferred embodiment when the pocket portion is provided as a containment for the bodily fluid waste bag, it may be desirable to also hide the connecting tubing. In this case, the pant leg would include a flap portion extending generally along the pant leg from near the opening of the pocket portion a predetermined length sufficient to reach the thigh area of the person. The flap portion has a width sufficient to cover the tubing connected to the bodily fluid waste bag, and further include means for securing the flap portion to the pant leg, wherein the tubing is thereby securable under the flap portion. Again, the means for securing the flap portion can be done in a number of ways known in the art, such as hook and loop fastener devices, or alternatively with snap buttons or regular buttons and button holes according to the look and style that the garment designer is trying to achieve and consideration of the fabric used.

Typically, when the feature for the bag and tubing is incorporated in the invention, the pant leg should be worn such that the flap and pouch or pocket is located generally along the inside of the leg of the person.

The invention further includes a shirt adapted for the person designed and configured to cover the mid-rift area of the person from the waist down to the thigh area. The shirt can be an accessory to the pant legs or vice-versa.

The shirt itself can be any style in appearance, such as button down, tennis shirt or golf shirt style or T-shirt style.

The shirt comprises a front body portion and a back body portion. The back body portion is sized and configured to have a length sufficient to extend down to proximately a small of the person's back. The intent is to cover the back area so as to minimize exposure of the lower back, while at the same time ensuring that the length is not so long as to bunch up in the small area of the back of the person.

The front body portion is sized and configured to have a length sufficient to extend down and be draped over the thigh area of the person. The intent is so that it is long enough to preferably drape and cover the upper portion of the pant legs in the thigh area.

The front body portion further has extended side portions or panels configured for draping over each side of the person's body from proximately a waist area of the person down to the thigh area of the person. The width of the extended side portions should be sufficient to cover the body sides from about the waist area or the bottom of back panel down to the thigh area. The bottom of the side portions typically would match or align with the bottom of the front body portion. The side portions can be cut from the same material as the front body portion of be separate side panels sewn to the front body portion, or the complete shirt can be cut from one piece and the ends sewn to minimize observable seams, according to the preferences of the pattern designer.

The side panels or extended side portions can be wide enough such that when the person turns, the side portions continue to cover the side of the person, including the thigh upper portion of the person's legs. However, in another embodiment, the clothing further includes means for securing each of the extended side portions to either the body part of shirt such as the back body portion of the shirt, the upper end of the corresponding pant leg or both the body part of the shirt and the upper end of the corresponding pant leg. Typically, this securing means has points of attachment located such that when the person turns to in a desired direction, the affected side portion maintains coverage of the side of the person from the mid-rift area down to the hips and to the upper thigh area of the person and to the upper end of the pant leg so that the mid-section of the person, including the upper thigh area, is not exposed. Again, this can be done in a number of ways known in the art as described above, including hook and loop fasteners, snap buttons, buttons and button holes, etc.

The inventive shirt can also be used by the handicapped person as a night shirt or sleep shirt.

DETAILED DESCRIPTION OF THE INVENTION

Figure 1A:
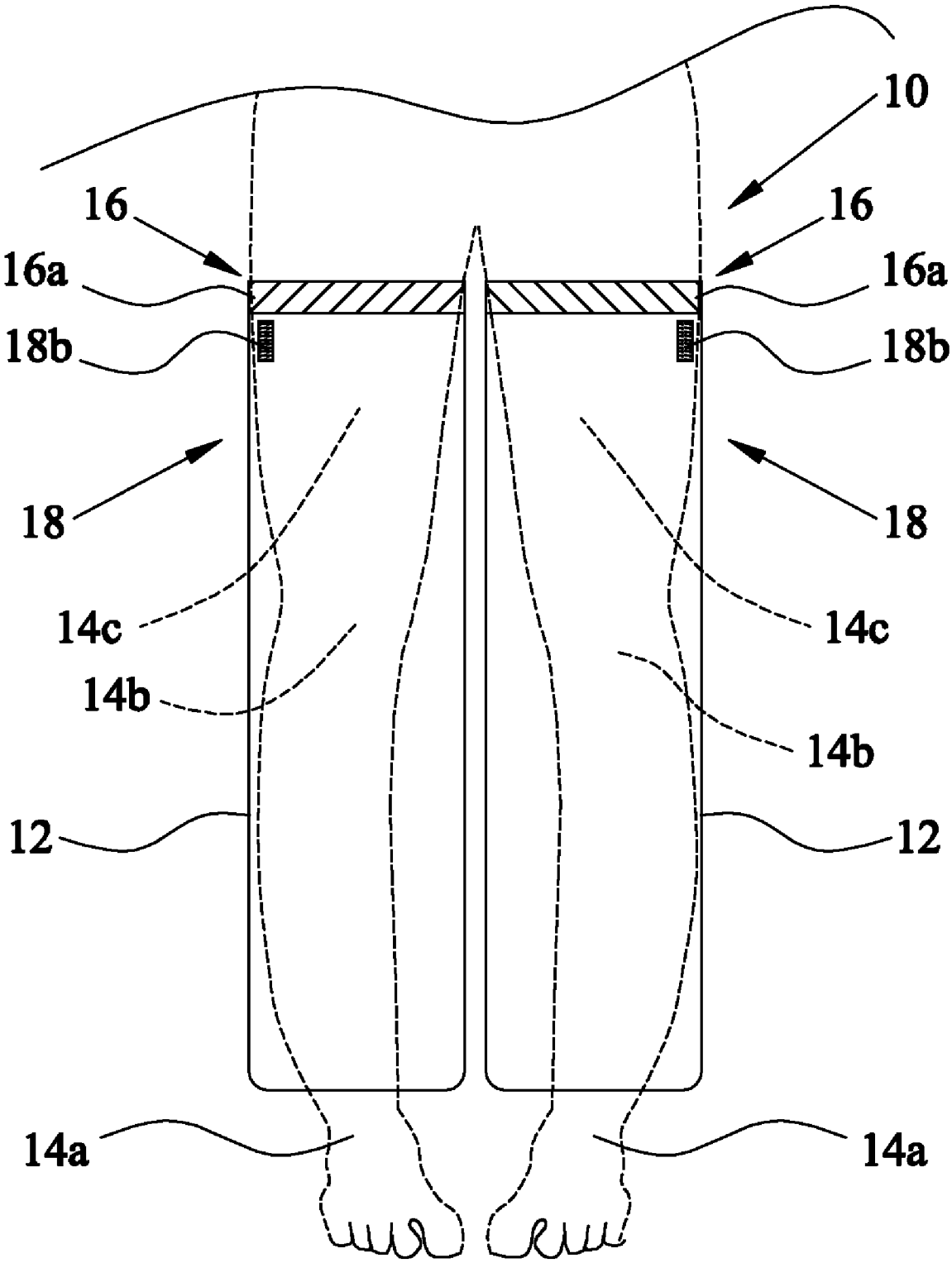
FIG. 1A is a conceptual depiction of the pant legs of the present invention.
Figure 1B:
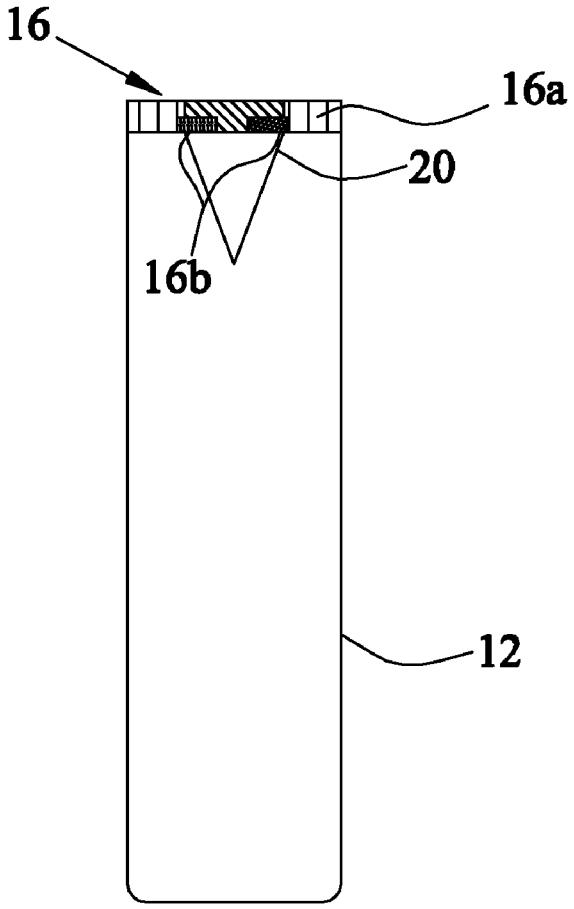
FIG. 1B is a conceptual depiction of another embodiment of the pant leg with the upper end cut to form a V-shape when opened.
Figure 1C:
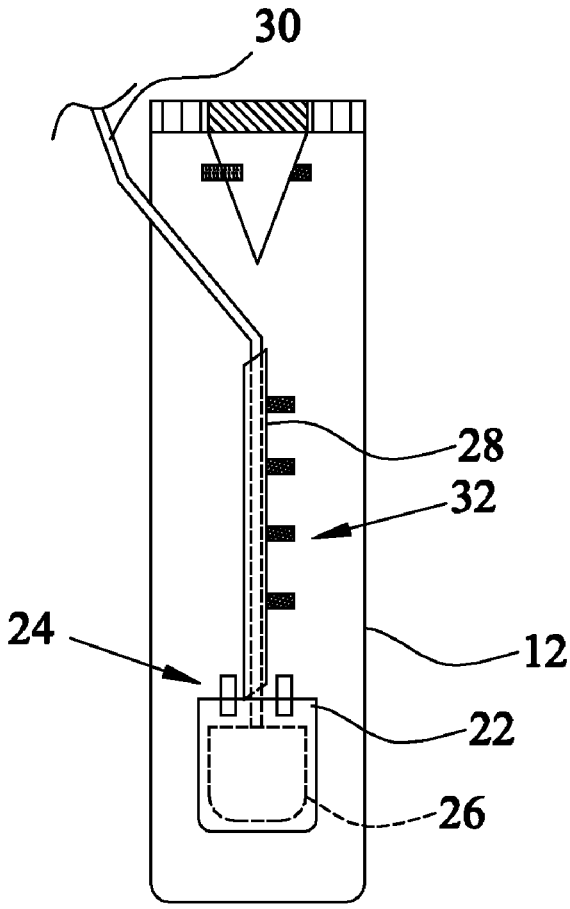
FIG. 1C is a conceptual depiction of another embodiment of the pant leg with a feature to store a bodily fluid waste bag in a pouch or pocket and a channel area formed within a flap to hide the tubing draining fluid into the waste bag.
Figure 2A:
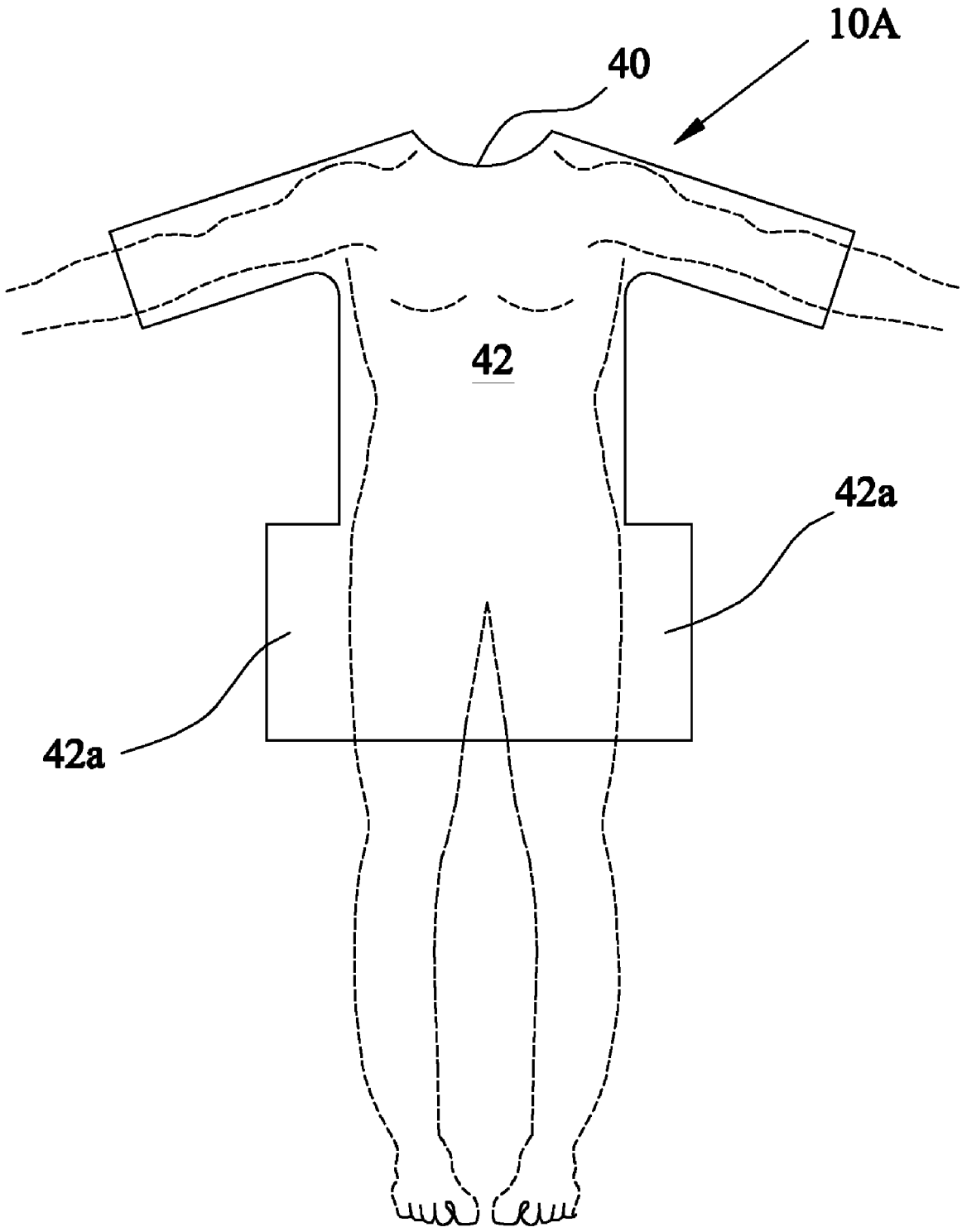
FIG. 2A is a conceptual depiction of another embodiment of the invention in the form of a shirt, specifically, the front part of the shirt with a draped portion at its lower end.
Figure 2B:
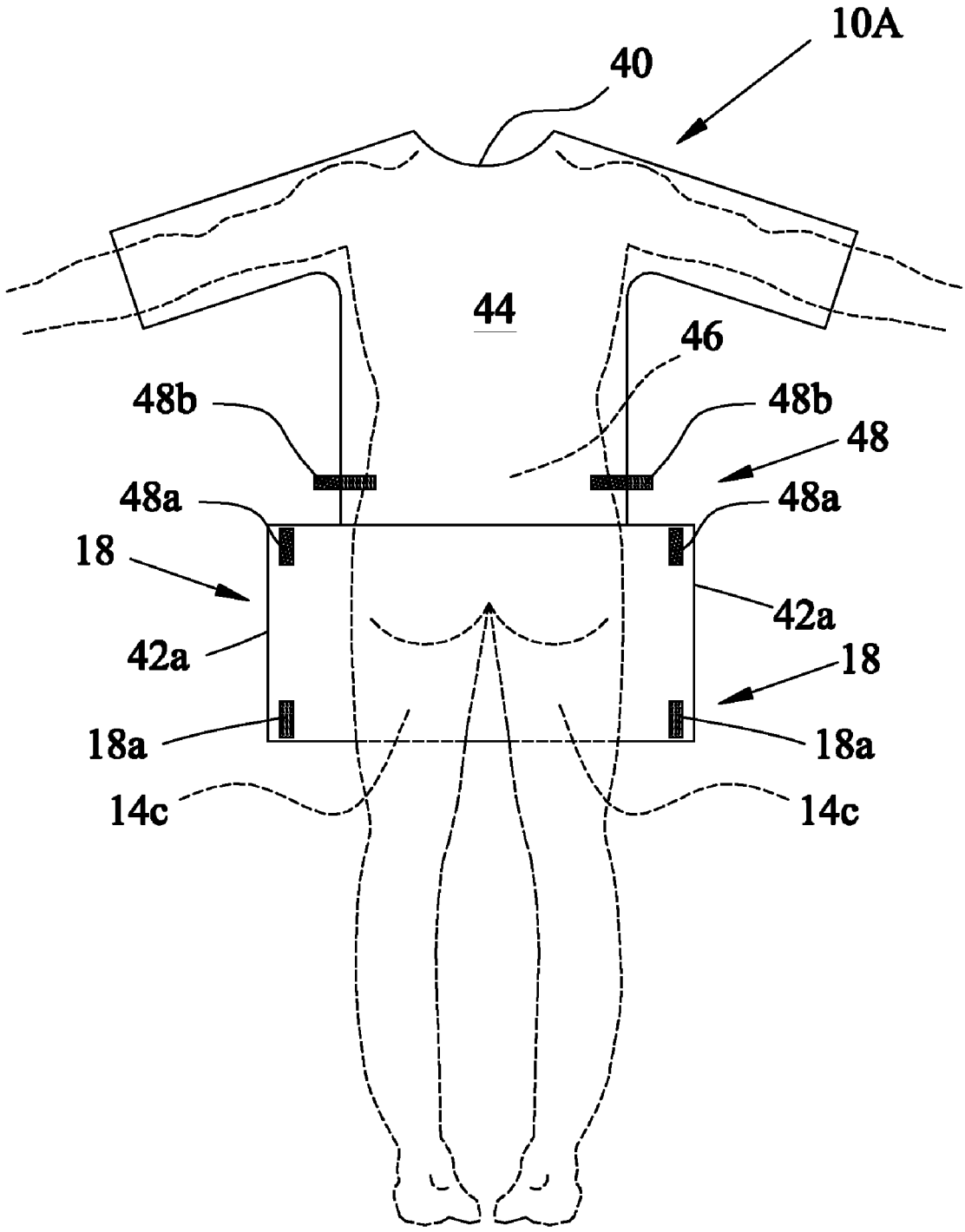
FIG. 2B is a conceptual depiction of the embodiment of the shirt of FIG. 2A depicting the shorter back portion.

The present invention is in the form of clothing for use by non-ambulatory people and wheelchair bound people and is generally depicted as 10, 10A in FIGS. 1A-1C and 2A-2B.

In one embodiment, the invention 10 is clothing for non-ambulatory and wheelchair bound people comprising a pair of pants legs 12 formed and sized to be pulled over a person's foot 14*a* and leg 14*b* and having a length so as to reach a person's thigh area 14*c*. The pant legs 12 each have means 16 at its upper end for securing the pant leg 12 to the thigh area 14*c*. In a preferred embodiment, the means 16 at its upper end for securing the pant leg 12 to the thigh area 14*c* is a sewn-in elastic band 16*a* or a strap using hook and loop type of fasteners 16*b*. Of course, there are other means known in the art that are contemplated to be used in the invention.

The important feature is that the person can place the pant legs on without the need to stand.

In another embodiment of the pant legs 12, a cut portion 20 at the upper end of each pant let 12 is included. The cut portion 20, when opened, forms a generally V-shaped cut. Also included are means 16*b* for closing and securing the cut portion, which for all practical purposes can be hook and loop fasteners which will also secure the legs 12 to the thigh area 14*c*. Again, there are several means 16*b* for closing and securing the cut portion known in the art including zipper means, or hook and loop fasteners having corresponding mating portions attached to each side of the formed V-shaped cut (see example in depiction). For a zipper, it can be similar to a fly zipper that connects the two sides of the cut. Hook and loop fasteners can also be aligned like a zipper would be aligned.

For the pant leg 12 and/or the cut 20, means such as snap buttons, regular buttons and button holes, can be used if desired according to the look and style that the garment designer is trying to achieve and consideration of the fabric used.

In another embodiment, the clothing 10 can include a pocket portion 22 near a bottom end of one of the pant legs 12. Although it certainly can be used for multiple purposes, it is a desired feature for primarily accommodating the placement and hiding of a bodily fluid waste bag 26. Preferably, the pocket portion 22 has means 24 for at least partially closing an opening of the pocket portion 22. Again, this can be done with hook and loop fastener devices (depicted by way of example), or alternatively with snap buttons or regular buttons and button holes.

In a preferred embodiment when the pocket portion 22 is provided as a containment for the bodily fluid waste bag 26, it may be desirable to also hide the connecting tubing. In this case, the pant leg would include a flap portion 28 extending generally along the pant leg 12 from near the opening of the pocket portion 22 a predetermined length sufficient to reach the thigh area 14*c* of the person. The flap portion has a width sufficient to cover the tubing 30 connected to the bodily fluid waste bag 26, and further includes means 32 for securing the flap portion 28 to the pant leg 12, wherein the tubing 30 is thereby securable under the flap portion 28. Again, the means 32 for securing the flap portion 28 can be done in a number of ways known in the art such as hook and loop fastener devices, or alternatively with snap buttons or regular buttons and button holes according to the look and style that the garment designer is trying to achieve and consideration of the fabric used.

Typically, when the feature for the bag 26 and tubing 30 is incorporated in the invention, the pant leg 12 should be worn such that the flap 28 and pouch or pocket 22 is located generally along the inside of the leg 14*b* of the person.

The invention 10A further includes a shirt 40 adapted for the person designed and configured to cover the mid-rift area of the person from the waist 46 down to the thigh area 14*c*. The shirt 40 can be an accessory to the pant legs 12 or vice-versa.

The shirt 40 itself can be any style in appearance, such as button down, tennis shirt or golf shirt style or T-shirt style.

The shirt 40 comprises a front body portion 42 and a back body portion 44. The back body portion 44 is sized and configured to have a length sufficient to extend down to proximately a small or waist area (referred to as lower back portion as well) 46 of the person's back. The intent is to cover the back are so as to minimize exposure of the lower back, while at the same time ensuring that the length is not so long as to bunch up in the small area of the back of the person.

The front body portion 42 is sized and configured to have a length sufficient to extend down and be draped over the thigh area 14*c* of the person. The intent is so that it is long enough to preferably drape and cover the upper portion of the pant legs 12 in the thigh area 14*c*.

The front body portion 42 further has extended side portions or panels 42*a* configured for draping over each side of the person's body from proximately a waist area 46 of the person down to the thigh area 14*c* of the person. The width of the extended side portions 42*a* should be sufficient to cover the body sides from about the waist area 46 or the bottom of back panel down to the thigh area 14*c*. The bottom of the side portions 42*a* typically would match or align with the bottom of the front body portion 42. The side portions can be cut from the same material as the front body portion of be separate side panels sewn to the front body portions, or the complete shirt can be cut from one piece and the ends sewn to minimize observable seams, according to the preferences of the pattern designer.

The side panels or extended side portions 42*a* can be wide enough such that when the person turns, the side portions continue to cover the side of the person, including the hip area and the thigh upper portion 14*c* of the person's legs 14*b*. However, in another embodiment, the clothing further includes means 18, 48 for securing each of the extended side portions to either the body part of shirt such as the back body portion 44 of the shirt 40 (depicted as 48*a*, 48*b* in FIG. 2B by way of example only), the upper end of the corresponding pant leg 12 (depicted as 18*a*, 18*b* in FIGS. 1A and 2B by way of example only), or both the body part of the shirt and the upper end of the corresponding pant leg. Typically, this securing means 18,48 has points of attachment located such that when the person turns to in a desired direction, the affected side portion maintains coverage of the side of the person from the mid-rift area 46 down to the hips and to the upper thigh area 14*c* of the person and to the upper end of the pant leg 12 so that the mid-section of the person, including the upper thigh area, is not exposed. Again, this can be done in a number of ways known in the art as described above, including hook and loop fasteners, snap buttons, buttons and button holes, etc.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. Clothing for non-ambulatory and wheelchair bound people, comprising, in combination:

A shirt and pair of accessory pant legs;

said shirt comprising a front body portion and a back body portion;

the back body portion being sized and configured to have a length sufficient to extend down to proximately a lower back portion of a person's back and ending near a waist level and above a derriere portion of a person wearing said shirt;

the front body portion being sized and configured to have a length sufficient to extend down and below said waist level and be draped over a thigh area of the person;

the front body portion further having extended side portions forming two opposite side modesty flaps integrated with a portion of said front body portion depending below said waist level, said modesty flaps being configured for covering each side of the person's derriere and hip portion for modesty purpose when said person is seated;

each of said accessory pant legs being separate and independent of each other and each being formed in generally tubular shape and sized to generally cover a person's leg with a vertical length that extends to an uppermost end corresponding to a person's thigh area; and said pant legs each having means at said uppermost end for securing the pant leg to the thigh area.

2. The clothing according to claim 1, further comprising means for securing each of the extended side portions to one of the back body portion of the shirt, an uppermost end of corresponding accessory pant legs or both the back portion of the shirt and the uppermost end of the corresponding accessory pant legs, said means having points of attachment located such that when the person turns to in a direction, the affected side portion maintains coverage of the side of the person.

3. The clothing according to claim 1, wherein said means at said uppermost end for securing the pant leg to the thigh area are mating hook and loop fasteners.

4. The clothing according to claim 1, further comprising:

a cut portion at the uppermost end of each pant leg, the cut portion when opened forming a generally V-shaped cut; and means for closing and securing the cut portion said means being located at said uppermost end of said pant leg.

5. The clothing according to claim 4, wherein the means for closing and securing the cut portion comprises hook and loop fasteners having corresponding mating portions attached to each side of the V-shaped cut.

6. The clothing according to claim 1, further comprising a pocket portion near a bottom end of one of said pant legs, the pocket portion having means for at least partially closing an opening of said pocket portion, the pocket portion being sized to hold a bodily fluid waste bag.

7. The clothing according to claim 6, further comprising:

a flap portion extending generally in a vertical direction along the pant leg form near the opening of the pocket portion a predetermined length sufficient to reach the thigh area of the person, said flap portion having a width sufficient to cover a tubing running vertically along an outside of said one of said pant legs, said tubing when in use being connected to the bodily fluid waste collection bag; and means for securing said flap portion to the pant leg, wherein said tubing is securable under the flap portion and generally covered so as to minimize a visibility of said tubing by bystanders.

* * * * *